US008585167B2

(12) United States Patent
Takahashi et al.

(10) Patent No.: US 8,585,167 B2
(45) Date of Patent: Nov. 19, 2013

(54) HINGE DEVICE AND ULTRA-DEEP FREEZER USING THE SAME

(75) Inventors: Yoshihiro Takahashi, Oizumi-machi (JP); Tomokazu Hashiba, Oizumi-machi (JP); Takashi Arai, Oizumi-machi (JP)

(73) Assignee: Panasonic Healthcare Co., Ltd., Tooa-shi, Ehime (JP)

( * ) Notice: Subject to any disclaimer, the term of this patent is extended or adjusted under 35 U.S.C. 154(b) by 16 days.

(21) Appl. No.: 13/276,604

(22) Filed: Oct. 19, 2011

(65) Prior Publication Data

US 2012/0104922 A1 May 3, 2012

(30) Foreign Application Priority Data

Oct. 29, 2010 (JP) ..... 2010-243637

(51) Int. Cl.
*A47B 96/04* (2006.01)

(52) U.S. Cl.
USPC ..... 312/405; 16/250

(58) Field of Classification Search
USPC ..... 312/401, 405; 16/250, 251, 221, 223, 16/235, 236, 237, 238, 247, 248, 254, 357, 16/358, 359, DIG. 43
See application file for complete search history.

(56) References Cited

U.S. PATENT DOCUMENTS

| | | | | |
|---|---|---|---|---|
| 4,766,519 | A * | 8/1988 | Heiland | 361/756 |
| 5,765,263 | A * | 6/1998 | Bolinas et al. | 16/342 |
| 6,444,901 | B1 * | 9/2002 | Bryant | 174/377 |
| 6,554,239 | B2 * | 4/2003 | Stilley et al. | 248/309.1 |
| 2005/0138955 | A1 * | 6/2005 | Okuda et al. | 62/441 |

FOREIGN PATENT DOCUMENTS

JP 10-061306 A 3/1998

* cited by examiner

*Primary Examiner* — Matthew Ing
(74) *Attorney, Agent, or Firm* — Westerman, Hattori, Daniels & Adrian, LLP

(57) ABSTRACT

A hinge device features improved ease of installation/removal of covers thereof to/from mounting bases thereof. The hinge device, which has mounting bases and knuckles, is connected such that it swings on a hinge pin inserted in the knuckles. The covers conceal mounting screws of the mounting bases. Each of the mounting bases has recesses formed in a side surface on a non-supporting side, grooves which are formed in a side surface adjacent to both ends in the axial direction of the hinge pin and which extend to a side surface, and an engaged portion concavely formed in each of the groove. The inner side of the cover has engaging portions which are inserted in the groove and which detachably engages with the engaged portion when the cover is installed, and also has protruding streaks which enter into and engage with the recesses.

2 Claims, 6 Drawing Sheets

HINGE DEVICE AND ULTRA-DEEP FREEZER USING THE SAME

BACKGROUND OF THE INVENTION

The present invention relates to a hinge device which swingably joins and holds a door or the like in an opened state or a closed state, and an ultra-deep freezer which uses the same.

Hitherto, a door or a cover provided at an opening is held in an opened state or a closed state by a hinge device swingably supported on one side of the opening. For example, the hinge device disclosed in Japanese Patent Application Laid-Open No. 10-61306 (patent document) is constructed of a first hinge member screwed to a main body, a second hinge member screwed to a door, and a hinge pin (a pin assembly).

The first hinge member has a mounting base and two knuckles formed on the mounting base with a predetermined distance provided therebetween in a direction in which the hinge pin extends. The second hinge member includes a mounting base and a locking knuckle for locking which is formed on the mounting base and which is placed between the knuckles of the first hinge member. Each knuckle of the first and the second hinge members has a through hole in the direction in which the hinge pin extends. The hinge pin is inserted in the through holes set in alignment, thereby holding the door, to which the mounting base of the second hinge member has been secured, such that the door swings on the hinge pin relative to the main body, to which the mounting base of the first hinge member has been secured.

In the conventional hinge device, each of the mounting bases has a plurality of screw holes for screwing the mounting base to the main body or the door. Further, each of the mounting bases has a removable cover for concealing mounting screws to be inserted in the screw holes.

In general, the mounting base is made of zinc die-casting, whereas the cover is made of a metal material, such as stainless steel. Further, the outer surface of the mounting base and the side surfaces positioned adjacently to both ends in the axial direction of the hinge pin have stepped portions for installing the cover, and both side surfaces have grooves for projections, which are formed on the cover, to be retained by fitting therein.

Thus, the cover is fitted to the stepped portion of the mounting base while slightly bending the cover, and the projections formed on the inner surface of the cover are fitted in the grooves in each of the mounting bases, thereby making it possible to install the cover to the mounting base.

The aforesaid construction, however, has been posing a problem in that the cover cannot be easily removed unless a tool, such as a flathead screwdriver, is inserted between the side surface of the mounting base adjacent to both ends in the axial direction of the hinge pin and the cover when detaching the cover from the mounting base for the purpose of maintenance or the like.

Hence, there have been a problem of preventing easy removal of the cover and also a problem of the possibility of scratching the cover and the side surfaces of the mounting bases by tools, resulting in deteriorated appearance, damage or the like.

The present invention has been made to solve the problems with the prior art, and it is an object thereof to provide a hinge device which permits easier attachment and detachment of a cover installed to a mounting base, and an ultra-deep freezer which uses the same.

SUMMARY OF THE INVENTION

To this end, a hinge device according to a first invention of the present application has a first hinge member and a second hinge member, each of which has a mounting base and a knuckle formed on one side of the mounting base, and a hinge pin inserted in a pin hole of each of the knuckles thereby to swingably join the second hinge member to the first hinge member, the hinge device including: a cover for concealing a mounting screw which is inserted in a screw hole formed in each of the mounting bases, wherein each of the mounting bases has a recess formed in a side surface positioned on the other side, grooves which are respectively formed in side surfaces positioned adjacently on both ends in the axial direction of the hinge pin and which extend to the side surface positioned on the other side, and an engaged portion concavely formed in each of the grooves, and the inner side of the cover has an engaging portion which is inserted in each of the grooves and which detachably engages with the engaged portion in a state in which the cover conceals the screw and also has the projection which enters into the recess to engage therewith.

In a hinge device according to a second invention of the present application, an end portion of the engaging portion that is positioned on the opposite side from the projection has an inclined surface in the invention described above.

In a hinge device according to a third invention of the present application, the cover has a protruding streak that enters into each of the grooves to engage therewith, and the engaging portion is formed so as to jut out beyond the protruding streak in the inventions described above.

A hinge device according to a fourth invention of the present application has a plurality of the recesses and the projections in the inventions described above.

In a hinge device according to a fifth invention of the present application, the screw hole is formed in a recessed portion formed in the mounting base, a reinforcement rib is formed in the recessed portion, and the cover also conceals the reinforcement rib in the inventions described above.

A hinge device according to a sixth invention of the present application has a first hinge member and a second hinge member, each of which has a mounting base and a knuckle formed on one side of the mounting base, a hinge pin being inserted in a pin hole of each of the knuckles thereby to swingably join the second hinge member to the first hinge member, the hinge device including: a cover for concealing a mounting screw which is inserted in a screw hole formed in each of the mounting bases, wherein each of the mounting bases has grooves which is formed in side surfaces positioned adjacently to both ends in the axial direction of the hinge pin and which extend to a side surface positioned on the other side, and also has an engaged portion concavely formed in the groove, and an inner side of the cover has an engaging portion which is inserted in the groove and which detachably engages with the engaged portion in a state in which the cover conceals the screw and also has a protruding streak which extends to the side surface positioned on the other side and enters into the groove to engage therewith, the engaging portion jutting out beyond the protruding streak.

An ultra-deep freezer according to a seventh aspect of the present invention includes a main body which is formed of heat-insulating walls and has a storage compartment therein, and a heat-insulating door which closes an opening of the storage compartment, wherein the first member of the hinge device according to any one of the first to the sixth inventions described above is screwed to the main body, while the second hinge member is screwed to the heat-insulating door, thereby swingably support the heat-insulating door on the main body such that the heat-insulating door may be opened/closed.

According to the first invention described above, the hinge device has the first hinge member and the second hinge member, each of which has the mounting base and the knuckle formed on one side of the mounting base, and the hinge pin is inserted in the pin hole of each of the knuckles thereby to swingably join the second hinge member to the first hinge member, the hinge device including the cover for concealing the mounting screw which is inserted in a screw hole formed in each of the mounting bases, wherein each of the mounting bases has a recess formed in a side surface positioned on the other side, grooves which are respectively formed in side surfaces positioned adjacently on both ends in the axial direction of the hinge pin and which extend to side surface positioned on the other side, and the engaged portion concavely formed in each of the grooves, and the inner side of the cover has an engaging portion which is inserted in each of the grooves and which detachably engages with the engaged portion such that the cover conceals the screw and also has the projection which enters into the recess to engage therewith. With this arrangement, the cover can be detachably installed to the mounting base by inserting the engaging portion of the cover into the grooves from the ends of the side surface positioned on the other side of the mounting base, and sliding the engaging portion until they engage with the engaged portion, thereby engaging the projections with the recess.

At this time, the projections of the cover enter into the recesses on the other side of the mounting base, while the engaging portions engage with the engaged portions at both ends in the axial direction of the hinge pin. This allows the cover to be stably attached to the mounting base without causing unduly firm engagement between the engaged portions and the engaging portions.

Thus, the cover can be attached and detached without the need for using a tool, in contrast to prior arts. Moreover, the engaging portions are guided into the grooves to engage with the engaged portions, thus permitting easier installation.

In addition to the aforesaid invention, according to the second invention described above, the end portion of the engaging portion positioned on the opposite side from the projection has an inclined surface, thus allowing the engaging portions of the cover to easily enter into the grooves to engage with the engaged portions. This arrangement permits further improved ease of the installation of the cover.

In addition to the inventions described above, according to the third invention described above, the cover has a protruding streak that enters into each of the grooves to engage therewith, and the engaging portion is formed so as to jut out farther than the protruding streak does. Hence, the protruding streak also enters into each of the grooves to engage therewith, allowing the cover to be installed with still higher stability, that is, enforced prevention of coming off.

Further, when engaging or disengaging the engaging portions with or from the grooves, the cover can be easily attached or detached without causing the cover to tilt relative to the mounting bases, since the protruding streaks and the grooves are in engagement.

In addition to the inventions described above, according to the aforesaid fourth invention, a plurality of the recesses and the projections is formed with a resultant improved engagement strength (the retaining force) at the other side of the mounting bases, thus making it possible to prevent uplifting or coming off.

In addition to the inventions described above, according to the fifth invention described above, the screw hole is formed in the recess formed in the mounting base, a reinforcement rib is formed in the recess, and the cover also conceals the reinforcement rib. Thus, the mounting base can be reinforced by the reinforcement rib, making it possible to prevent or restrain the occurrence of a crack in the mounting base. Moreover, since the cover also conceals the reinforcement rib, the appearance can be improved.

The hinge device according to the sixth invention has the first hinge member and the second hinge member, each of which has the mounting base and the knuckle formed on one side of the mounting base, and the hinge pin is inserted in the pin hole of each of the knuckles thereby to swingably join the second hinge member to the first hinge member, the hinge device including: the cover for concealing the mounting screw which is inserted in the screw hole formed in each of the mounting bases, wherein each of the mounting bases has the grooves which are formed in the side surfaces positioned adjacently to both ends in the axial direction of the hinge pin and which extend to the side surface positioned on the other side, and also has the engaged portion concavely formed in each of the grooves, and the inner side of the cover has the engaging portion which is inserted in the groove and which detachably engages with the engaged portion in a state in which the cover conceals the screw and also has the protruding streak which extends to the side surface positioned on the other side and enters the groove to engage therewith, the engaging portion jutting out beyond the protruding streak. With this arrangement, the cover can be detachably installed to the mounting base by inserting the engaging portion of the cover into the grooves from the end of the side surface positioned on the other side of the mounting base, by sliding the engaging portion until it engages with the engaged portion, and at this time, by moving the protruding streak extending to the side surfaces positioned on the other side into the groove so as to engage therewith.

At this time, since the protruding streaks of the cover are formed such that they extend to the side surface on the other side, the cover can be installed with still higher stability, that is, enforced prevention of coming off, without causing unduly firm engagement between the engaged portions and the engaging portions. Hence, the cover can be stably attached and detached without the need for using a tool, in contrast to prior arts.

The ultra-deep freezer according to the seventh invention of the present application includes the main body which is formed of heat-insulating walls and has the storage compartment therein, and the heat-insulating door which closes the opening of the storage compartment, wherein the first member of the hinge device according to any one of the first invention to the sixth invention described above is screwed to the main body, while the second hinge member is screwed to the heat-insulating door, thereby swingably support the heat-insulating door on the main body such that the heat-insulating door may be opened and closed. With this arrangement, the hinge device in which the mounting bases of the first and the second hinge members are screwed allows a thick and therefore heavy heat-insulating door of an ultra-deep freezer to be swingably supported with no difficulty, thus making the aforesaid inventions ideally suited for an ultra-deep freezer.

DETAILED DESCRIPTION OF THE PREFERRED EMBODIMENT

Figure 1:
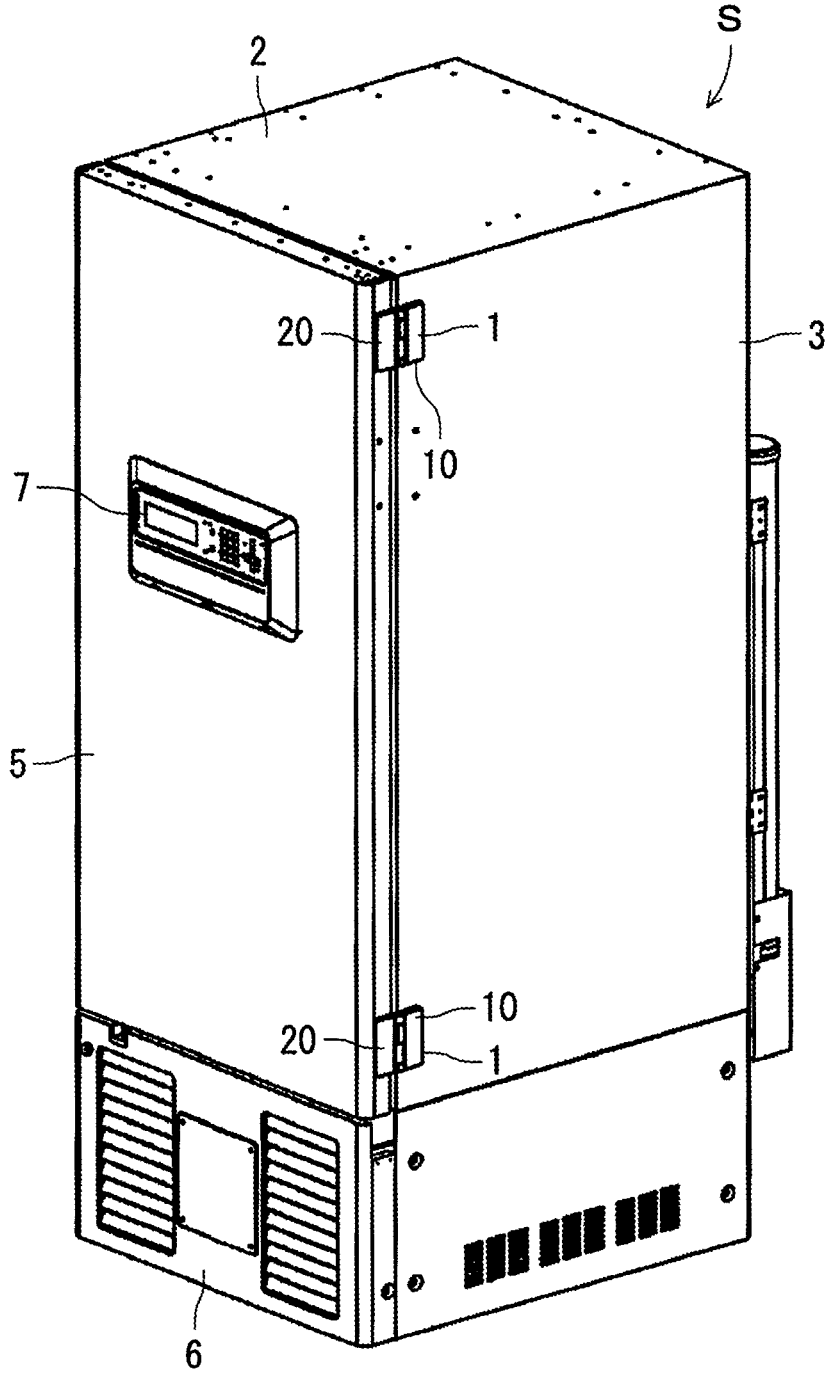
FIG. 1 is a perspective view of an ultra-deep freezer to which a hinge device in accordance with the present invention has been applied.

The following will describe in detail an embodiment of a hinge device 1 in accordance with the present invention, taking an ultra-deep freezer S, to which the hinge device 1 has been applied, as an example.

The ultra-deep freezer (ultra-cold storage) S according to the present embodiment is used for, e.g., storing frozen food to be kept at low temperature for an extended period or for cryopreservation of body tissues or specimens. The main body of the ultra-deep freezer S is formed of a heat-insulating box unit 2, which opens to the front.

The heat-insulating box unit 2 is constructed of an outer box 3 and an inner box, both of which open to the front, a plastic breaker (not shown) connecting the front ends of the two boxes, and a polyurethane resin insulating material filled in the space encompassed by the outer box 3, the inner box, and the breaker according to an on-the-spot foaming method. The interior of the aforesaid inner box provides the storage compartment that opens to the front.

The front surface of the breaker is formed to be stepped, and a heat-insulating door 5 is provided through a gasket (not shown) by a plurality of the hinge devices 1 and 1 such that the door 5 swings on one end, i.e., one side in the present embodiment. Thus, the front opening of the storage compartment in the heat-insulating box (the main body) 2 is openably closed by the heat-insulating door 5.

Further, provided under the heat-insulating box unit 2 is a unit assembly 6 having a cooling unit for cooling the interior of the storage compartment to a predetermined cooling temperature, such as an extremely cold temperature of −85° C. or below. Further, a control panel 7 for making various types of settings of an ultra-deep freezer 6 is provided on the front surface of the heat-insulating door 5.

In the present embodiment, in order to set a target temperature in the storage compartment (the temperature in the storage) to, for example, −85° C. or below, the heat-insulating box unit 2, which separates the storage compartment from the outdoor air, is required to have a higher heat insulating capability than that of a low-temperature storage, the temperature of the interior of which is set to approximately 0° C. Hence, securing such a high heat insulating capability by using only the aforesaid polyurethane resin insulating material would require a layer of the heat insulating material be considerably thick. This means that it would impossible to secure an adequate storage volume of the storage compartment due to a limited size of the main body. As a solution to the problem, the heat-insulating box unit 2 in the present embodiment has the outer box 3, the inner wall surface of which is provided with a glass-wool vacuum insulating material, thus reducing the thickness of the layer of the polyurethane resin insulating material, depending on the heat insulating capability imparted by the vacuum insulating material.

Further, the heat-insulating door 5, which openably closes the front opening of the storage compartment kept at an extremely low temperature, is made of a polyurethane resin insulating material or a glass-wool vacuum insulating material, as with the heat-insulating box unit 2, in order to accomplish a high heat insulating capability. However, the thickness of the heat-insulating door 5 is normally required to be approximately 6 cm, which causes the heat-insulating door 5 itself to weigh as heavy as approximately 20 kg. This means that the hinge devices 1 for swingably retaining the heat-insulating door 5 onto the heat-insulating box unit 2, which is the main body, would be required to be capable of holding a significant weight.

Figure 2:
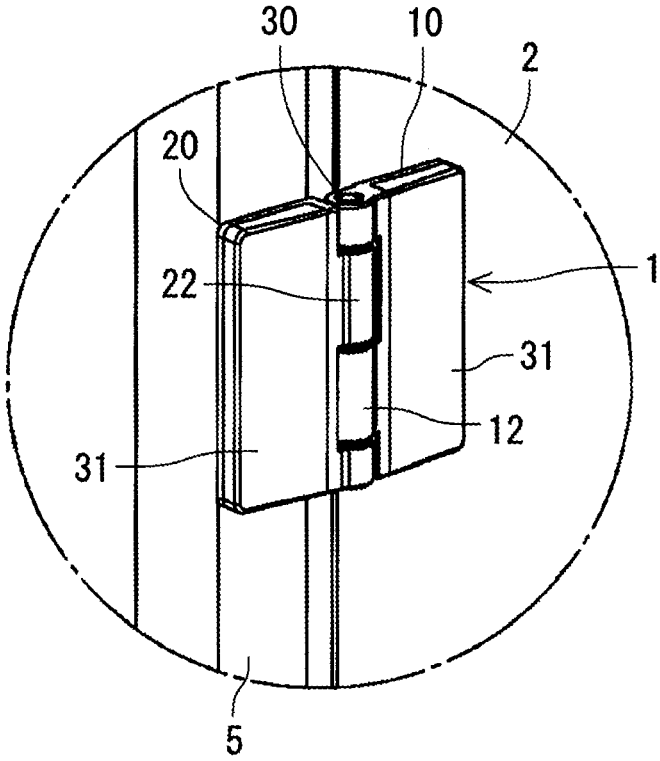
FIG. 2 is an enlarged perspective view of a hinge device of the ultra-deep freezer illustrated in FIG. 1.
Figure 3:
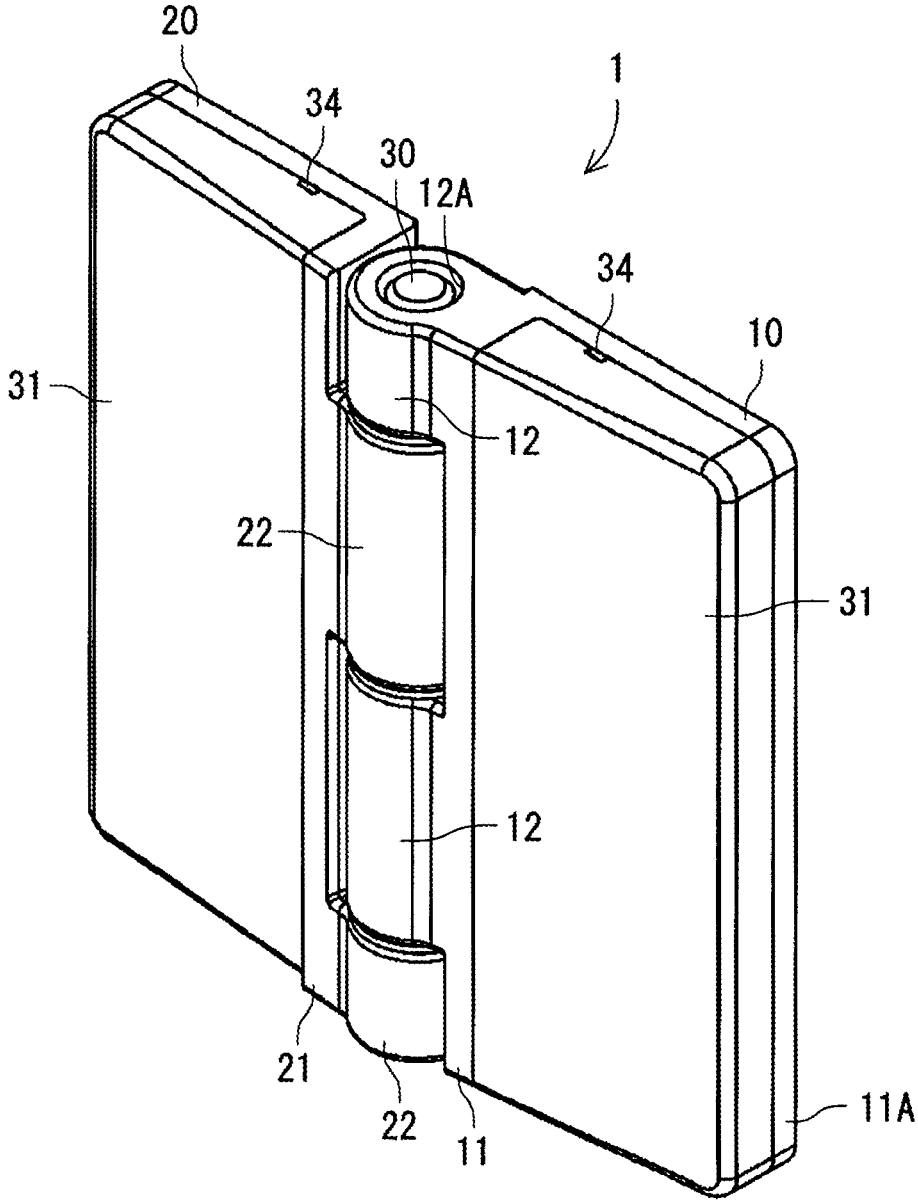
FIG. 3 is a perspective view of the hinge device.
Figure 4:
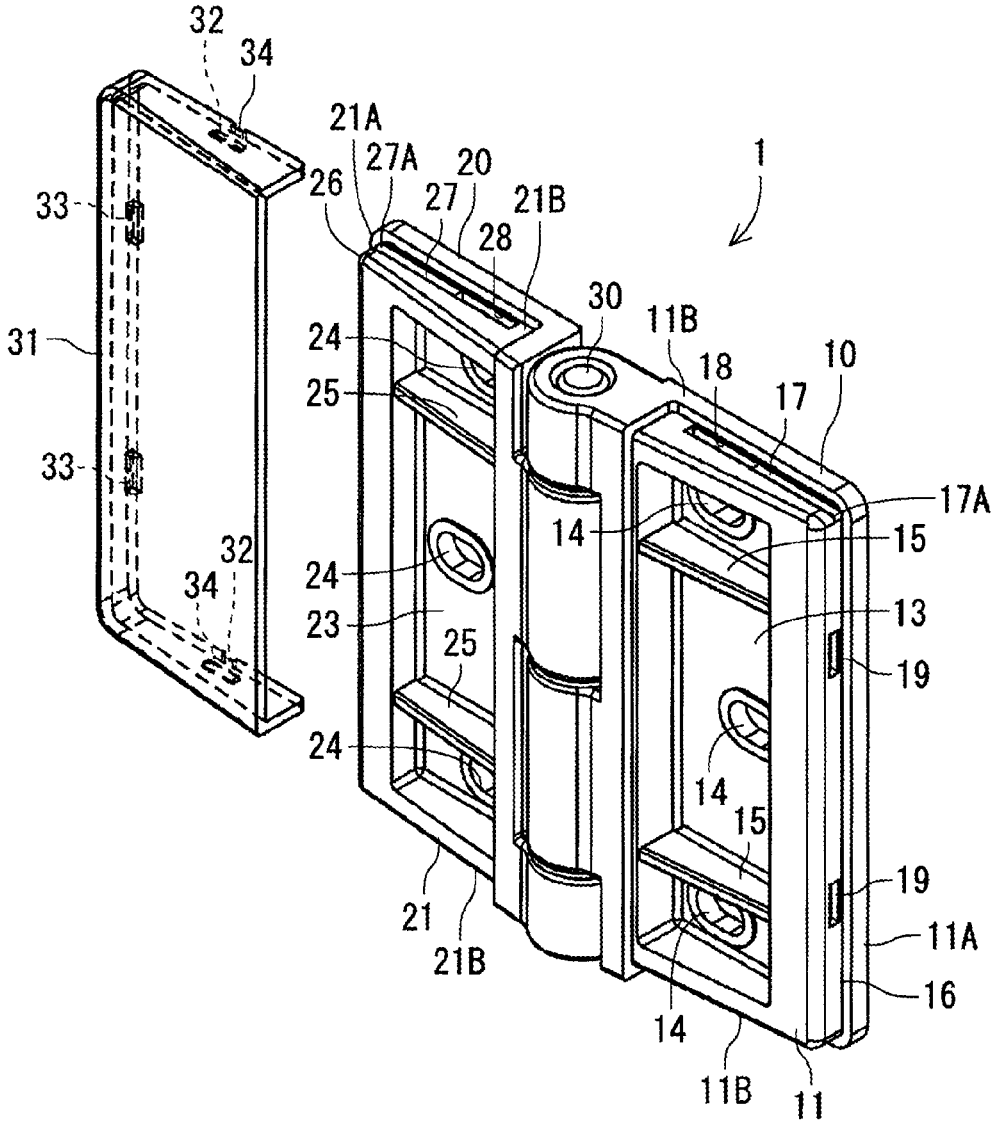
FIG. 4 is an exploded perspective view of the hinge device with a cover thereof removed.
Figure 5:
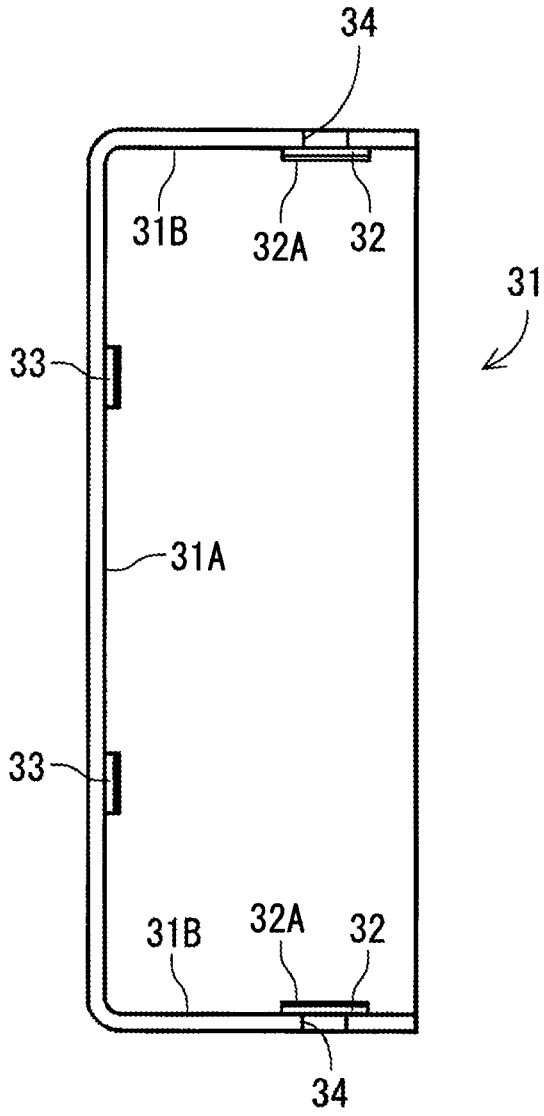
FIG. 5 is a plan view of the cover.

Referring to FIG. 2 to FIG. 5, the hinge device 1 in accordance with the present invention will be described in more detail. FIG. 2 is an enlarged perspective view of the hinge device 1 of the ultra-deep freezer illustrated in FIG. 1, FIG. 3 is a perspective view of the hinge device 1, FIG. 4 is an exploded perspective view of the hinge device 1 with a cover removed, and FIG. 5 is a plan view of the cover.

The hinge device 1 is composed of a first hinge member 10 secured by screws to the front edge portion of a side surface (the edge of the front opening) of the heat-insulating box unit 2 of the ultra-deep freezer, a second hinge member 20 secured by screws to the heat-insulating door 5, which openably closes the front opening of the heat-insulating box unit 2, and a hinge pin 30 inserted in the pin hole of knuckles of the hinge members 10 and 20.

The first hinge member 10 and the second hinge member 20 are composed of mounting bases 11 and 21, respectively, which have a plurality of (two in this case) knuckles 12, 12 and 22, 22, respectively, on one side (supporting side). The mounting bases 11 and 21 are molded by zinc die-casting.

Each of the knuckles 12 and 22 formed on the mounting bases 11 and 21, respectively, has a pin hole 12A penetrating in the axial direction of the hinge pin 30 (the pin hole of the knuckle 22 being not shown). The knuckles 12 and 22 formed on the hinge members 10 and 20 are formed such that they project from the mounting bases 11 and 21 at positions where they engage with each other. With this arrangement, the pin holes are aligned in a state wherein the knuckles 12 and 22 are alternately adjacent and mesh with each other, allowing the hinge pin 30 to be inserted in the adjoining knuckles 12 and 22.

Further, recessed portions 13 and 23, which retreat farther toward the heat-insulating box unit 2 or the heat-insulating door 5 than the outer peripheral edges of the mounting bases 11 and 21, are formed at the outer surface sides of the mounting bases 11 and 21. The recessed portions 13 and 23 have a plurality of screw holes 14 and 24 in which mounting screws (not shown) for securing the heat-insulating box unit 2 or the heat-insulating door 5 are inserted. In the present embodiment, a plurality of the screw holes 14 and 24 is formed in the axial direction of the hinge pin 30.

Further, in the present embodiment, a plurality of reinforcement ribs 15 and 25 is formed in the recessed portions 13 and 23 at positions avoiding the screw holes 14 and 24 in a direction substantially orthogonal to the axial direction of the hinge pin 30. Thus, the relatively heavy heat-insulating door 5 is held by the screws effectively reinforced by the reinforcement ribs 15 and 25, which extend in a direction substantially orthogonal to the axial direction of the hinge pin 30, against load applied in the axial direction of the hinge pin 30 at the locations of the screw holes 14 and 24. Hence, even in the case of the hinge device 1 which swingably retains the heavy heat-insulating door 5, in particular, as with the present embodiment, the occurrence of cracks in the mounting bases 11 and 21 can be prevented or restrained. Thus, the heat-insulating door 5 can be prevented from coming off, allowing the door to be safely opened or closed.

Meanwhile, covers 31 and 31 for concealing the screw holes 14 and 24 formed in the recessed portions 13 and 23, the reinforcement ribs 15 and 25, and the mounting screws inserted in the screw holes 14 and 24 are removably installed to the mounting bases 11 and 21. The cover 31 attached to the mounting base 11 or 21 can be shared by reversing it in the axial direction of the hinge pin 30.

In the mounting bases 11 and 21, side surfaces 11A and 21A positioned on the other sides (non-supporting sides) that are opposite from the sides adjacent to the knuckles 12 and 22 and side surfaces 11B and 21B positioned adjacently to both ends in the axial direction of the hinge pin 30 have stepped portions 16 and 26, which house and retain the covers 31 such that the covers are substantially flush with the side surfaces 11A, 21A and 11B, 21B, as illustrated in FIG. 3.

The stepped portions 16 and 26 positioned on the side surfaces 11A and 21A have recesses 19 (recesses in the side surface 21A being not shown), which are further recessed inward than the stepped portions 16 and 26. In the present embodiment, a plurality of, for example, two, recesses 19 are provided side by side in the axial direction of the hinge pin 30. The number of the recesses 19 is not limited to two, and may be one or three or more.

The stepped portions 16 and 26 formed on the side surfaces 11B and 21B also have grooves 17 and 27, respectively, which extend from the vicinity of the hinge pin 30 to the side surfaces 11A and 21A, respectively. Formed in the end portions of the grooves 17 and 27 adjacent to the hinge pin 30 are engaged portions 18 and 28, which are formed by deepening the grooves.

Meanwhile, the covers 31 are formed of, for example, a hard synthetic resin (e.g., ABS) and shaped to be rectangular members, which have the surfaces thereof adjacent to the mounting bases 11 and 21 and the hinge pin 30 being open. The covers 31 have engaging portions 32 and 32, which jut out toward the stepped portions 16 and 26, on the inner surfaces 31B thereof corresponding to both end portions in the axial direction of the hinge pin 30 (the surfaces corresponding to the aforesaid side surfaces 11B and 21B).

Each of the engaging portions 32 is inserted into the groove 17 or 27 from a groove end portion 17A or 27A opened in the vicinity of the side surface 11A or 21A, and is allowed to slide by being guided by the groove 17 or 27. Further, the engaging portion 32 is detachably engaged with the engaged portion 18 or 28 in a state wherein the cover 31 conceals the recessed portion 13 or 23 of the mounting base 11 or 21.

In the present embodiment, cutouts 34 and 34 permitting the insertion of a tool, such as a flathead screwdriver, are formed in the end surfaces of the mounting base 11 or 21 at positions corresponding to the positions where the engaging portions 32 are formed. Further, the inner end surfaces 32A of the engaging portions 32 (the end surfaces facing the grooves 17 or 27) have approximately trapezoidal sections retreated toward the cutouts 34.

Further, an inner surface 31A of the cover 31 (the surface corresponding to the aforesaid side surface 11A or 21A) corresponding to the other side (non-supporting side), which is the opposite side from the knuckles 12 or 22 of the mounting base 11 or 21, has projections 33 jutting out toward the stepped portions 16 or 26. The projections 33 are formed at positions corresponding to the recesses 19 formed in the side surface 11A or 21A of the mounting base 11 or 21. When a plurality of the recesses 19 is formed, the projections 33 in the same quantity as the quantity of the recesses 19 are formed. In the present embodiment, there are the two recesses 19, so that the two projections 33 are formed.

In the construction described above, with the covers 31 and 31 removed, the mounting base 11 of the first hinge member 10 is secured by the mounting screws to the front edge of a side surface of the heat-insulating box unit 2, and the mounting base 21 of the second hinge member 20 is secured by the mounting screws to a side surface of the heat-insulating door 5. This allows the heat-insulating door 5, to which the second hinge member 20 has been secured, to swing about the axial direction of the hinge pin 30 with respect to the heat-insulating box unit 2, to which the first hinge member 10 has been secured. Thus, the heat-insulating door 5 is swingably supported on the heat-insulating box unit 2 such that the door 5 may be opened/closed.

The recessed portions 13 and 23 of the mounting bases 11 and 21, respectively, are concealed by installing the covers 31 and 31. At this time, first, the end surface of the cover 31 that opens toward the hinge pin 30 is applied to the end portion of the side surface 11B or 21B of the mounting base 11 or 21, the end portion being adjacent to the side surface 11A or 21A, and the engaging portion 32 formed on an inner surface 31B of the cover 31 is inserted into the groove 17 or 27 from a groove end portion 17A or 27A formed on the side surface 11B or 21B of the mounting base 11 or 21. The cover 31 is slid toward the hinge pin 30 by being guided by the groove 17 or 27. In the state wherein the cover 31 conceals the recessed portion 13 or 23 (the mounting screws) of the mounting base 11 or 21, the engaging portion 32 of the cover 31 falls in and engages the engaged portion 18 or 28 formed in the groove 17 or 27.

Further, in this state, the projections 33 and 33 formed on the inner surface 31A of the cover 31 enter into and engage with the recesses 19 formed in the side surface 11A or 21A of the mounting base 11 or 21.

With the arrangement described above, the engaging portions 32 of the cover 31 are inserted into the groove 17 or 27 from the groove end portion 17A or 27A adjacent to the side surface 11A or 21A of the mounting base 11 or 21, and slid until the engaging portions 32 engage with the engaged portion 18 or 28, and then the projections 33 are engaged with the recesses 19 or the like. This allows the cover 31 to be detachably installed to each of the mounting bases 11 and 21.

At this time, the cover 31 is installed by the projections 33 entering into the recesses 19 at the side surface 11A or 21A (the other side) of the mounting base 11 or 21, while the engaging portions 32 engaging with the engaged portions 18 or 28 at both ends in the axial direction of the hinge pin 30 (at the side surface 11B or 21B). This arrangement makes it possible to stably install the cover 31 to each of the mounting base 11 and 21 without causing excessively firm engagement between the engaged portion 18 or 28 and the engaging portion 32.

The cover 31 can be removed by sliding the cover 31 away from the hinge pin 30 to release the engaging portions 32 of the cover 31 from the engaged portion 18 or 28 by taking advantage of the flexibility thereof and also to clear the engagement between the projections 33 and the recesses 19 or the like.

Thus, the covers 31 can be attached and detached without using a tool, in contrast to prior arts. Moreover, the engaging portions 32 engage with the engaged portions 18 or 28 by being guided by the groove 17 or 27, leading to improved ease of the installation. In particular, the cover 31 can be slid along the side surface of the heat-insulating box unit 2 or along the side surface of the heat-insulating door 5 with the heat-insulating door 5 closed, thus allowing the cover 31 to be further easily attached and detached.

Further, a plurality of the projections 33 formed on the covers 31 and the recesses 19 and the like formed in the mounting bases 11 and 21 improves the engagement strength (retaining force) at the side surfaces 11A and 21A (the other side) of the mounting bases 11 and 21 when the covers 31 have been attached to the mounting bases 11 and 21. This makes it possible to restrain uplifting or coming off.

As described above, the mounting bases 11 and 21 have the reinforcement ribs 15 and 25 in the recessed portions 13 and 23, in which the screw holes 14 and 24 are formed, so as to improve the strength of the mounting bases 11 and 12. The reinforcement ribs 15 and 25 are also concealed together with the screws by the covers 31, permitting improved appearance.

Further, in the present embodiment, if the covers 31 made of a resin should incur deformation or the like, preventing themselves from smoothly sliding along the mounting bases 11 and 21, then the engaging portions 32 can be smoothly released from the engaged portions 18 and 28 by inserting a tool, such as a flathead screwdriver, into the cutouts 34 and moving the tip of the tool along the trapezoidal inner end surfaces 32A of the engaging portions 32. This permits smooth removal of the covers 31 in the worst case.

Figure 6:
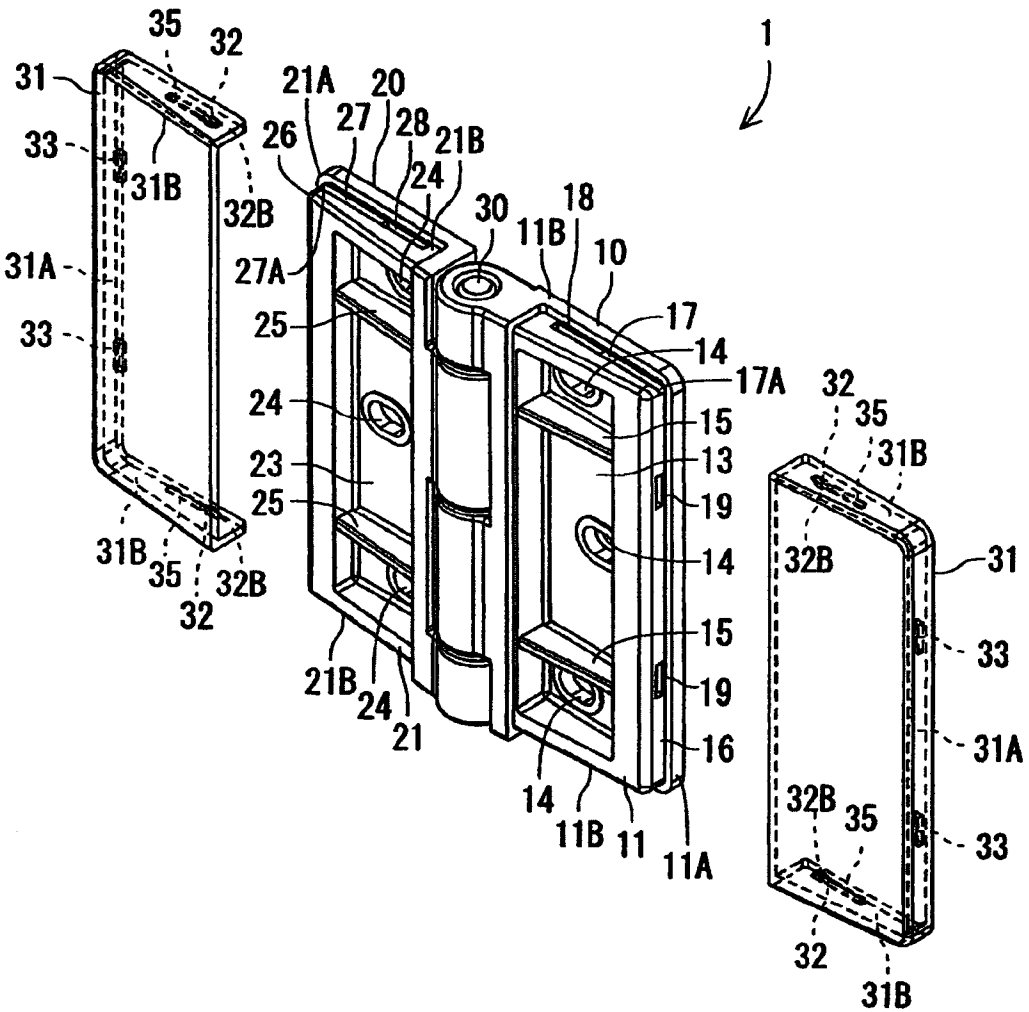
FIG. 6 is an exploded perspective view of the hinge device according to another embodiment with a cover thereof removed.

As in the case of another embodiment illustrated in FIG. 6, end portions positioned at the opposite side from projections 33, namely, end portions 32B adjacent to a hinge pin 30, of engaging portions 32 formed on a cover 31 may have inclined surfaces that incline toward the hinge pin 30. Further, the engaging portions 32 may have protruding streaks 35 located at the side of the projections 33, i.e., at the side of the inner surface 31A, the protruding streaks 35 extending toward an inner surface 31A and entering into and engaging with a groove 17 or 27. The engaging portions 32 are to be formed such that they jut out farther than the protruding streaks 35 do. In other words, the engaging portions 32 are formed on end portions of the protruding streaks 35 at one side (the side adjacent to a knuckle) of the mounting base such that the engaging portions 32 jut out beyond the protruding streaks 35 in a state wherein the cover 31 has been attached to the mounting base 11 or 21.

With the construction described above, the inclined surfaces formed on the end portions 32B of the engaging portions 32 positioned on the opposite side from the protruding streaks 33 allow the engaging portions 32 of the cover 31 to easily enter into the groove 17 or 27 to engage with the engaged portion 18 or 28. This permits further improved ease of the installation of the cover 31.

Further, the formation of the protruding streaks 35, which enter into and engage with the groove 17 or 27, on inner surfaces 31B of the cover makes it possible for the protruding streaks 35 to enter into and engage with the groove 17 or 27 of the mounting base 11 or 21 together with the engaging portions 32, which are formed to jut out farther than the protruding streaks 35 do. Hence, the covers 31 can be installed with still higher stability (enhanced prevention of coming off).

Further, since the protruding streaks 35 are in engagement with the groove 17 or 27, the engaging portions 32 can be easily inserted in or removed from the groove 17 or 27 without causing the cover 31 to tilt relative to the mounting base 11 or 21. The ease of the installation can be further improved.

Further, as an alternative (not shown), the protruding streaks 35, which enter into and engage with the groove 17 or 27, may be formed on the inner surfaces 31B of the cover 31 such that the protruding streaks 35 extend to the side surface positioned on the other side, i.e., an inner surface 31A. This arrangement allows the protruding streaks 35 to enter into and engage with the entire groove 17 or 27 together with the engaging portions 32, which are formed so as to jut out beyond the protruding streaks 35. Thus, the cover 31 can be installed with still higher stability (enhanced prevention of coming off) without causing excessively firm engagement between the engaged portions 18 or 28 and the engaging portions 32. Hence, the covers 31 can be stably installed to or removed from the mounting bases 11 and 21 without using a tool, in contrast to the prior arts.

The hinge device 1 in the present embodiment has been described with reference to the case where the heat-insulating door 5 of an ultra-deep freezer S is swingably supported on the heat-insulating box unit 2 such that the door opens and closes, as described above; however, the present invention is not limited thereto. The present invention can be applied to any other cases as long as the first hinge member 10 is fixed to one counterpart and the second hinge member 20 is fixed to the other counterpart thereby to connect the paired counterparts such that they may swing about the hinge pin 30.

In the case where the heat-insulating door 5 swingably connected as with the ultra-deep freezer S has a thick insulation and a large weight as described above, the hinge device 1 adapted to screw the mounting bases 11 and 21 of the first and the second hinge members 10 and 20, respectively, as in the present invention is more ideally used, since the hinge device 1 makes it possible to swingably support the heavy heat-insulating door 5 with no difficulty.

What is claimed is:

1. A hinge device, comprising a first hinge member and a second hinge member, each of which has a mounting base, a knuckle formed on one side of each of the mounting bases, a hinge pin being inserted in a pin hole of each of the knuckles thereby to swingably join the second hinge member to the first hinge member, and a cover for concealing a mounting screw which is inserted in a screw hole formed in each of the mounting bases, wherein each of the mounting bases further comprises a recess formed in a side surface on an opposite side from the knuckle, grooves which are respectively formed in side surfaces of the mounting bases adjacent to both ends of the hinge pin and which extend to the side surface on the opposite side from the knuckle, and an engaged portion concavely formed in each of the grooves, wherein inner sides of the cover have engaging portions which are inserted in the grooves and which detachably engage with the engaged portions in the grooves in a state in which the cover conceals the mounting screw, and said cover also has a projection which enters into the recess formed in the side surface positioned on the opposite side from the knuckle to engage therewith, wherein the cover has a protruding streak that enters into each of the grooves to engage therewith, and the engaging portion is formed so as to jut out beyond the protruding streak;

wherein the recess and the projection are formed in a plural quantity; and wherein the screw hole is formed in a recessed portion formed in the mounting base, a reinforcement rib is formed in the recessed portion, and the cover also conceals the reinforcement rib.

2. The hinge device according to claim 1, wherein an end portion of the engaging portion has an inclined surface.

* * * * *